US006364315B1

(12) United States Patent
Velke, III

(10) Patent No.: US 6,364,315 B1
(45) Date of Patent: Apr. 2, 2002

(54) OUTDOOR GAME KIT WITH RADIO FREQUENCY TRANSMITTERS AND RECEIVERS

(76) Inventor: John Velke, III, 450 County Road 164, Jemison, AL (US) 35085

( * ) Notice: Subject to any disclaimer, the term of this patent is extended or adjusted under 35 U.S.C. 154(b) by 0 days.

(21) Appl. No.: 09/563,661

(22) Filed: May 2, 2000

(51) Int. Cl.[7] ..... A63F 9/00
(52) U.S. Cl. ..... 273/454; 273/460
(58) Field of Search ..... 273/454, 459, 273/460; 340/323 R, 572.1, 568.1, 568.2, 571

(56) References Cited

U.S. PATENT DOCUMENTS

| | | | | | |
|---|---|---|---|---|---|
| 3,443,338 | A | * | 5/1969 | Collins | 446/301 |
| 4,272,916 | A | | 6/1981 | Giordano et al. | |
| 4,496,149 | A | * | 1/1985 | Schwartzberg | 273/454 |
| 4,658,928 | A | | 4/1987 | Seo | |
| 4,660,039 | A | | 4/1987 | Barricks et al. | |
| 4,961,575 | A | | 10/1990 | Perry | |
| 4,962,369 | A | * | 10/1990 | Close | 340/572.1 |
| 5,072,213 | A | * | 12/1991 | Close | 340/568.2 |
| 5,099,228 | A | * | 3/1992 | Israel et al. | 340/568.2 |
| 5,204,657 | A | * | 4/1993 | Prosser et al. | 340/571 |
| 5,661,470 | A | * | 8/1997 | Karr | 340/572.5 |
| 5,900,817 | A | | 5/1999 | Olmassakian | |

* cited by examiner

*Primary Examiner*—Raleigh W. Chiu
(74) *Attorney, Agent, or Firm*—Kenneth M. Bush; Sirote & Permutt, P.C.

(57) ABSTRACT

A game kit for playing a variety of outdoor games, comprising a plurality of animal-shaped game pieces, wherein each of the game pieces has at least one light-emitting device and at least one sound-emitting device; a plurality of radio frequency receivers, wherein each of the receivers is encased within an animal-shaped game piece and is operable to activate the light-emitting device and the sound-emitting device; at least one radio frequency transmitter adapted to be worn by a player and operable to activate the radio frequency receivers; and a container for storing and transporting the game kit components. Each of the receivers is activated when a player wearing a transmitter enters a predetermined detection zone around each of the receivers, thereby causing the light-emitting device to emit light and the sound-emitting device to emit sound. The game kit preferably includes other components, such as a flag, a game book, a stopwatch, and balloons.

7 Claims, 2 Drawing Sheets

OUTDOOR GAME KIT WITH RADIO FREQUENCY TRANSMITTERS AND RECEIVERS

FIELD OF THE INVENTION

The present invention relates generally to children's games. More particularly, the present invention relates to a game kit comprising components which can be used for playing a variety of outdoor games.

BACKGROUND OF THE INVENTION

Children enjoy recreational activities and parents frequently prefer that these recreational activities are enjoyed outdoors. During the warmer months, children commonly play outdoors late into the evening; however, children are limited in their choice of outdoor games which can be played after dark. Consequently, there is a need for outdoor games which can be played during the day or night. Further, there is a need for outdoor games which can be played with as few as two players to multiple players.

Accordingly, what is needed, and is not found in the prior art, is a game kit comprising a plurality of components which can be adapted for playing a variety of outdoor games during the day or night, limited only by the collective imagination of the players.

SUMMARY OF THE INVENTION

An object of the present invention is to provide a game kit comprising components which can be used for playing a variety of outdoor games.

Another object of the present invention is to provide a game kit comprising components which can be used for playing games during the day or night.

Another object of the present invention is to provide a game kit comprising components which can be used for playing games with as few as two players to multiple players.

These and other objects of the present invention are accomplished with an outdoor game kit, comprising a plurality of animal-shaped game pieces, wherein each of the game pieces has at least one light-emitting device and at least one sound-emitting device; a plurality of radio frequency receivers, wherein each of the receivers is encased within an animal-shaped game piece and is operable to activate the light-emitting device and the sound-emitting device; at least one radio frequency transmitter adapted to be worn by a player and operable to activate the radio frequency receivers; and a container for storing and transporting the game kit components. Each of the receivers is activated when a player wearing a transmitter enters a predetermined detection zone around each of the receivers, thereby causing the light-emitting device to emit light and the sound-emitting device to emit sound. The game kit preferably includes other components, such as a flag, a game book, a stopwatch, and balloons.

These and other objects and advantages of the invention will become apparent from the following detailed description of the preferred embodiment of the invention.

DESCRIPTION OF THE PREFERRED EMBODIMENT

Figure 1:
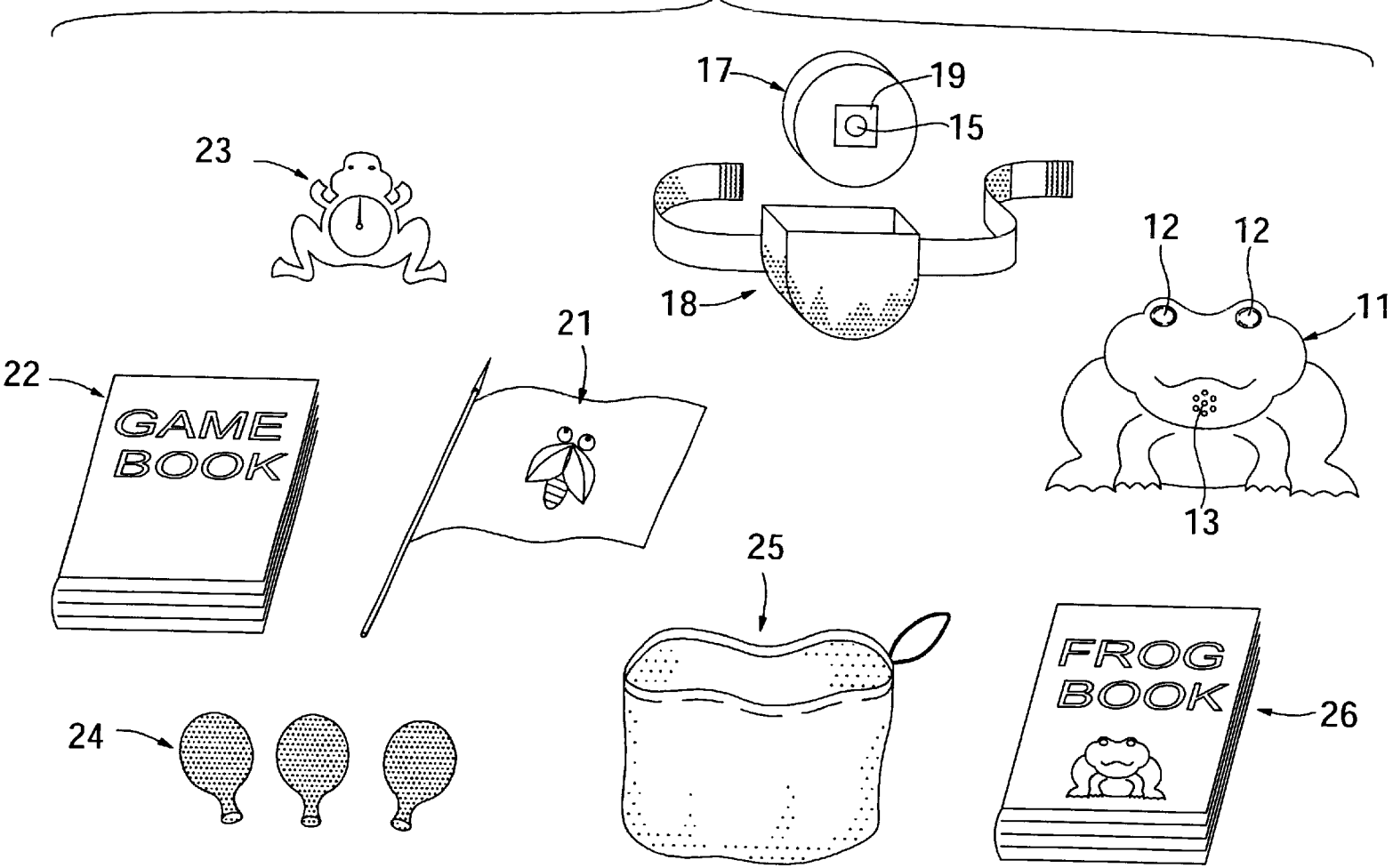
FIG. 1 is a perspective view of the various game kit components.
Figure 2:
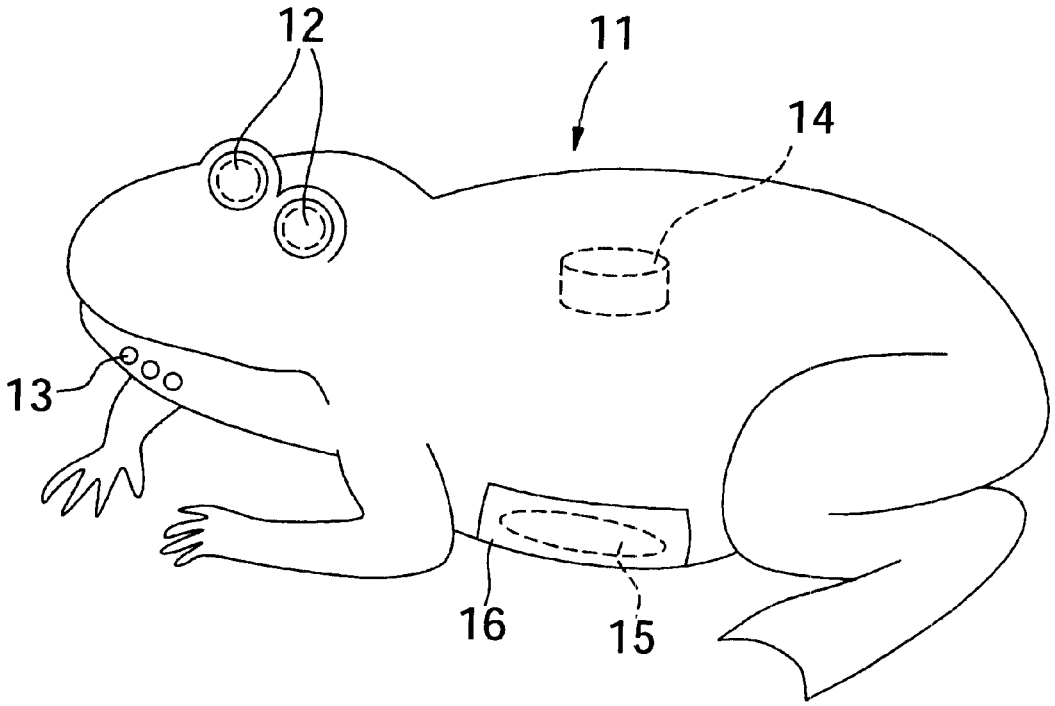
FIG. 2 is an enlarged perspective view of the animal-shaped game piece.

According to the preferred embodiment of the present invention, the game kit comprises a plurality of animal-shaped game pieces 11. The game pieces can all resemble the same animal (e.g. frogs), or can resemble different animals (e.g. a frog, a rabbit, a squirrel, etc.). The game pieces are preferably formed of a hard, durable plastic. Each game piece 11 comprises at least one light-emitting device 12, such as light bulbs for "eyes", and at least one sound-emitting device 13, such as an audio speaker in the "mouth". Each game piece 11 further comprises a radio frequency receiver 14, preferably encased within the game piece, which is operable to activate the light-emitting device 12 and the sound-emitting device 13. The radio frequency receiver 14, light-emitting device 12, and sound-emitting device 13 are interconnected via electronic circuitry (not shown) and are powered by a replaceable battery 15 (or batteries), which resides within an access panel 16 preferably located on the bottom of each game piece 11. A power switch (not shown) allows each game piece to be positioned "on" or "off" and may include a "test" position to check proper functioning of the game piece. An alternate embodiment of the game piece (not shown) comprises transparent plastic and has an internal light-emitting device such that when activated, the entire game piece is illuminated.

The kit further comprises at least one radio frequency transmitter 17, wherein each transmitter is associated with an article 18 adapted to be worn by a player. For example, the transmitter 17 can be attached to an adjustable belt or armband, inserted into a pants or shirt pocket, or formed as part of a wrist band or necklace. Each transmitter 17 is powered by a replaceable battery 15 (or batteries), which resides within an access panel 19, and is operable to activate the radio frequency receivers 14 such that when a player wearing a transmitter 17 enters a predetermined detection zone around each of the receivers 14 (e.g. 5 foot radius), the transmitter 17 activates the receiver 14 which, in turn, activates the light-emitting device 12 to emit light and the sound-emitting device 13 to emit sound. Once activated, the light-emitting device 12 and the sound-emitting device 13 will stay on as long as the transmitter 17 is in the detection zone or for a predetermined duration, such as 5–10 seconds, after which the receiver 14 will return to a stand-by mode until it is again activated as described above.

The game kit preferably includes other components, such as a flag 21, a game book 22 describing a variety of different games, a stopwatch 23 for use with timed games, and balloons 24 which can be filled with water. It is anticipated that game kits according to the present invention can be tailored around a particular theme. For example, the kit can be directed to a particular type of animal, such as a frog. In this case, the components would all be directed to a frog motif, such as a kit comprising:

1. Three plastic game pieces 11, each resembling a large green frog, wherein each game piece comprises 2 light bulb "eyes" which can be activated to emit light and a "mouth" having an audio speaker connected to a sound chip which can be activated to emit a "croaking" sound;
2. An adjustable green belt 18 having a pouch for holding a transmitter 17;
3. A transmitter 17;
4. A green flag 21, preferably 12×12 inches, with a large black fly imprinted thereon;
5. An instruction/game book 22 illustrating how the game components work and providing a variety of games that can be played using the components;

6. A green sack 25 for storing and transporting the game components;
7. A "frog" book 26 providing fun and educational stories about the life of frogs, their habitat, language, and eating habits;
8. A stopwatch 23 enclosed in a green plastic case shaped like a frog; and
9. A plurality of green balloons 24.

Examples of games utilizing the foregoing components include the following:

EXAMPLE 1

"Capture the Fly"

A game for three or more players.

Rules

The field is divided into two sections. One section is occupied by Player/Team #1, which defends the "Fly" flag. The other section is the "Home Field" for Player/Team #2.

Player/Team #1 distributes the frogs on the playing field in the "on" position. Player/Team #1 positions the flag in plain view of the opposing player(s). One player on Team #2 wears the transmitter belt and attempts to capture the flag and return with it to his/her side of the field without activating a frog or being tagged by Player/Team #1. Additional Players on Team #2 also attempt to capture the flag and return with it to their side of the field but do not run the risk of being "tagged" by a frog.

The flag may not be positioned inside the detection zone of a frog.

The player chosen to wear the transmitter belt must keep it in the "on" position during the entire game.

Anytime the player wearing the transmitter belt activates a frog, he/she must return to the "Home Field". If the player possesses the flag at the time of the activation, the flag must immediately be dropped.

Players on Team #2 who are tagged by players on Team #1 are captured and must remain in a designated area on the defenders' side of the field until released by a team member. Releasing of captured prisoners occurs when a Team #2 player tags their team member without first being tagged by a Team #1 player.

The game ends when a player on Team #2 returns to the Home Field with the flag or when Team #1 captures all of the Team #2 players.

EXAMPLE 2

"Frogmen"

A game for two or more players.

Rules

Player/Team #1 selects a location for a Fort and distributes frogs in the "on" position as sentries around the perimeter.

Player/Team #1 occupies the Fort with an arsenal of water balloons.

Player/Team #2 wears the transmitter belt(s) and attempts to sneak up on the Fort and lob water balloons at Player/Team #1 without activating the frogs.

Player/Team #1 defends the Fort by lobbing water balloons at Player/Team #2.

The frogs provide Player/Team #1 notice of the presence of Player/Team #2 and may assist them in the targeting of their balloons.

The game ends when both teams exhaust their supply of water balloons.

The transmitter and the frogs must be left "on" throughout the game.

Player/Team #1 may not leave the Fort.

Water balloons must be lobbed, not thrown at the head of a Player.

EXAMPLE 3

"Leap Frog"

A timed obstacle course for two or more players.

Rules

Player #1 distributes frogs throughout the playing field in the "on" position. Player #2 wears the transmitter belt and runs around the playing field jumping over frogs while Player #1 records the time using the frog stopwatch. Player #1 will know that Player #2 actually jumped frogs by seeing and hearing the frogs activated. The course is complete when all of the frogs have been activated. Each player takes a turn running the course. The player with the best time wins.

EXAMPLE 4

"Hide & Croak"

A timed hide-and-seek game for two or more players.

Rules

Player #2 hides their eyes while Player #1 hides the frogs on the playing field.

Player #2 wears the transmitter belt.

Player #2 takes a sack and goes looking for frogs. As a frog is found/activated, Player #2 turns it "off" and collects it in his/her sack. Player #1 records the time from the start until all of the frogs are found.

Each player takes a turn hiding the frogs and each player takes a turn looking for them. The player who finds all of the frogs in the least amount of time wins.

EXAMPLE 5

"Red Light/Green Frog"

A game of tag for two or more players.

Rules

Player #1 wears the transmitter belt.

With the transmitter "off", Player #1 distributes the frogs on the playing field. The frogs are in the "off" position.

Player #1 returns to Home Base and turns on the transmitter belt to start the game.

The other player(s) run around attempting to avoid being tagged by Player #1. When a player finds a frog, he/she can turn it "on" thus creating a zone that Player #1 cannot enter without activating the frog.

Whenever a frog is activated, Player #1 may not tag another player.

The object of the game for Player #1 is to tag each of the other players causing them to have to return to Home Base and sit out the rest of the game. When all the players have been tagged, a new player is chosen to wear the belt and the game starts again.

Player #1 cannot turn frogs off.

Players may not move the frogs other than to pick them up and turn them on.

Players may not carry the frogs.

Players may not stand still inside the detection zone of a frog.

Player #1 must keep the transmitter belt in the "on" position once the game begins.

EXAMPLE 6

"Frog Gigging"

A parent/child nighttime game.

Rules

A parent distributes the frogs while the child is not looking. The child wears the transmitter belt and carries a flashlight. Parent and child go into the yard to hunt frogs. The objective is to get the frogs before they get you. The child uses the flashlight to spot frogs without entering the detection zones. When a frog is spotted the child sends the parent to pick it up. The parent picks it up, turns it "off", and puts it in the sack. If any frog is activated the child must release all the previously captured frogs to be redistributed by the parent. The game ends when the child has successfully spotted and captured all of the frogs.

EXAMPLE 7

"Lilly Pad"

A game for young children (4 to 7 players).

Rules

Player #1 wears the transmitter belt. One frog is used for each additional player. The frogs are put together on the ground.

With the transmitter belt in the "off" position, and while the other players are not looking, Player #1 turns one of the frogs to the "on" position. Player #1 then looks away while each of the other players select a frog. Players make their selection without looking to see which frog has been turned on.

Each player with a frog takes it to a position in the yard where they sit with the frog on an imaginary Lilly pad. Players should be far enough apart that the frog in the "on" position does not activate when Player #1 approaches a player with a frog in the "off" position.

Once all the players are seated with their frog, Player #1 turns on the transmitter belt and begins to approach players in an order of their choosing.

The object of the game is for Player #1 to approach each player and pat them on the head, activating the "on" frog last. If a frog is activated before all other players have been patted, the player with the activated frog switches places with Player #1 and the game starts over. This process is repeated until there is a winner.

It is to be understood that the form of the invention shown is a preferred embodiment thereof and that various changes and modifications may be made therein without departing from the spirit of the invention or scope as defined in the following claims.

Having set forth the nature of the invention, what is claimed is:

1. A game kit for playing a variety of outdoor games, comprising:

a plurality of animal-shaped game pieces, wherein each of said game pieces has at least one light-emitting device and at least one sound-emitting device;

a plurality of radio frequency receivers, wherein each of said receivers is attached to an animal-shaped game piece and is operable to activate said light-emitting device to emit light and said sound-emitting device to emit sound;

a plurality of radio frequency transmitters, wherein each of said transmitters is attached to an article adapted to be worn by a player and is operable to activate said radio frequency receivers;

wherein each of said receivers is activated when a player wearing one of said transmitters enters a predetermined detection zone around each of said receivers, thereby causing said light-emitting device to emit light and said sound-emitting device to emit sound;

a flag for use as a game objective for possession by a player or a team of players;

a game book for describing a plurality of games which can be played using the game kit; and a container for storing and transporting the game kit components.

2. A game kit according to claim 1, wherein each animal-shaped game piece has an appearance resembling a frog.

3. A game kit according to claim 1, wherein said container is a green bag.

4. A game kit according to claim 1, further comprising a stopwatch for setting time periods in which games played with the game kit must be completed.

5. A game kit according to claim 4, wherein said stopwatch is enclosed within a case having an appearance resembling a frog.

6. A game kit according to claim 1, further comprising a plurality of balloons for filling with water such that said balloons filled with water can be thrown at another player.

7. A game kit for playing a variety of outdoor games, comprising:

a plurality of animal-shaped game pieces, each resembling a frog, wherein each of said game pieces comprises at least one light-emitting device and at least one sound-emitting device;

a plurality of radio frequency receivers, wherein each of said receivers is attached to an animal-shaped game piece and is operable to activate said light-emitting device to emit light and said sound-emitting device to emit a "croaking" sound;

at least one radio frequency transmitter adapted to be worn by a player and operable to activate said radio frequency receivers;

wherein each of said receivers is activated when a player wearing said transmitter enters a predetermined detection zone around each of said receivers, thereby causing said light-emitting device to emit light and said sound-emitting device to emit said "croaking" sound;

a flag having a large black fly imprinted thereon for use as a game objective for possession by a player or a team of players;

an instruction book for describing a plurality of games which can be played using the game kit;

a plurality of balloons for filling with water such that said balloons filled with water can be thrown at another player;

a stopwatch enclosed in a plastic case resembling a frog for setting time periods in which games played with the game kit must be completed; and a bag for storing and transporting the game kit components.

* * * * *